United States Patent [19]

Steinle et al.

[11] 4,341,930

[45] Jul. 27, 1982

[54] ELECTRODYNAMIC LOUDSPEAKER

[75] Inventors: Günter Steinle, Mönchweiler; Edwin Lässle, Langenau, both of Fed. Rep. of Germany

[73] Assignee: Dual Gebrüder Steidinger GmbH & Co., St. Georgen, Fed. Rep. of Germany

[21] Appl. No.: 130,502

[22] Filed: Mar. 14, 1980

[30] Foreign Application Priority Data

Mar. 14, 1979 [DE] Fed. Rep. of Germany ..... 2909880

[51] Int. Cl.[3] ..... H04R 9/06

[52] U.S. Cl. ..... 179/115.5 R; 179/115.5 VC

[58] Field of Search ..... 179/115.5 R, 115.5 DV, 179/115.5 H, 115.5 ME, 115.5 VC, 180; 181/175, 176

[56] References Cited

U.S. PATENT DOCUMENTS

| | | | |
|---|---|---|---|
| 1,820,585 | 8/1931 | Tolerton | 179/115.5 R |
| 2,067,582 | 1/1937 | Sperling | 181/175 |
| 2,537,723 | 1/1951 | Ward | 179/115.5 ME |
| 2,621,261 | 12/1952 | Karlsson et al. | 179/115.5 R |
| 2,926,221 | 2/1960 | Kagdis | 179/115.5 R |
| 3,796,839 | 3/1974 | Torn | 179/115.5 R |
| 3,935,402 | 1/1976 | Gersten | 179/115.5 VC |

FOREIGN PATENT DOCUMENTS

| | | | |
|---|---|---|---|
| 2162347 | 6/1973 | Fed. Rep. of Germany . | |
| 831978 | 9/1938 | France . | |
| 1041547 | 10/1953 | France | 179/115.5 ME |
| 1217136 | 5/1960 | France | 179/115.5 DV |
| 239988 | 10/1947 | Switzerland | 179/115.5 R |

*Primary Examiner*—George G. Stellar

*Attorney, Agent, or Firm*—Martin A. Farber

[57] ABSTRACT

An electrodynamic loudspeaker having a cone diaphragm within which there is arranged a centrally located body which influences the acoustic radiation. This body is formed by an extension of the magnet core of the moving coil which extension is enlarged in the region of the mouth of the cone to form a partial covering of the cone chamber up to about half of the diameter of the cone mouth. The central part of the covering is approximately equal to one and a half times the diameter of the magnet core and forms a closed surface. In the remaining edge area of the covering there are axially arranged passages, the cross-sections of which occupy approximately one-half of this edge area. An electrodynamic loudspeaker with a cone diaphragm also has a support of the moving coil which extends beyond its point of attachment to the diaphragm up into the space within the cone diaphragm and with the end of this extension dips into a cap-shaped part which is secured fixedly to the loudspeaker while retaining a slight radial clearance therebetween.

3 Claims, 2 Drawing Figures

ELECTRODYNAMIC LOUDSPEAKER

Figure 1:
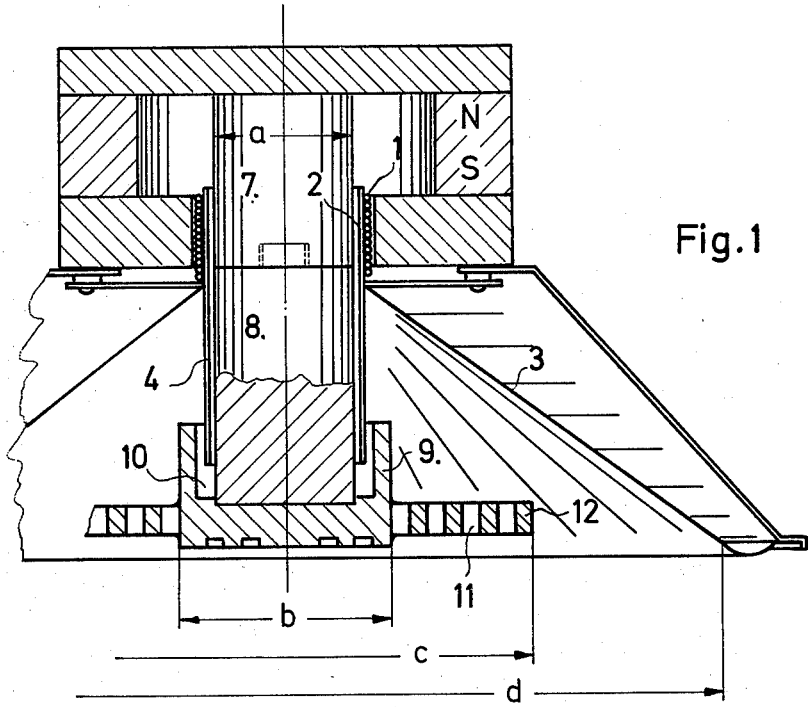

The present invention relates to an electrodynamic loudspeaker having a cone diaphragm. Such loudspeakers have the disadvantage that they distort the sound to be reproduced in a specific manner which is characteristic of the cone diaphragm and is generally referred to as "cone sound." Various arrangements have already become known the purpose of which was to eliminate this disadvantage. In accordance with French Pat. No. 831,978 a conical body is arranged for this purpose in the space surrounded by the diaphragm. In this way, however, a noticeable improvement in the acoustic impression can be obtained only at the cost of a considerable loss of radiated acoustic power and, even when applied to the electrodynamic loudspeakers customary today whose moving coil is covered by a cap they did not produce a result which is truly satisfactory.

It has recently been attempted, in accordance with German Unexamined Application for Pat. No. 21 62 347, to eliminate the cone sound by arranging a corresponding body having a convex surface in front of the loudspeaker. Such an arrangement, however, has the disadvantage in particular, that it is very cumbersome for the ordinary use of loudspeakers.

Another method which has been recently attempted in order to improve the acoustic impression is the use of a flat diaphragm. The stiffness necessary for the diaphragm has, however, also resulted in a corresponding increase in weight and thus a poorer pulse behavior.

The object of the present invention is to obtain a more natural acoustic impression by modification of the shape of the body in order to improve the sound, without thereby having to substantially reduce the radiation power of the loudspeaker or tolerate distortion. Its solution is an electrodynamic loudspeaker having a cone diaphragm within which there is arranged a centrally located body which serves to influence the acoustic radiation, characterized by the fact that this body is formed by an extension (8) of the magnet core (7) of the moving coil (1), which extension is enlarged in the region of the cone mouth to form a partial covering (1) of the cone chamber, namely to up to about half (c) of the diameter of the cone mouth (d), the central part (b) of the covering (12), of a size approximately equal to one and a half times the diameter (a) of the magnet core (7) of the moving coil (1), forming a closed surface, and there being contained in the remaining edge region (c-b) of the covering (12) axially arranged passages (11) whose cross sections take up approximately one-half of this edge region (c-b).

The body in accordance with the invention which serves to influence the acoustic radiation can, for instance, be fastened by three arms to the rim of the loudspeaker near the edge of the diaphragm, or else they may, in particularly advantageous manner, be fastened directly to the magnet core of the moving coil (embodiment in accordance with FIG. 1). In this case, the cap which is customarily fastened to the diaphragm and which prevents penetration of foreign substances into the air gap between the moving coil and its magnet core must be done away with. This has the advantage that there is no longer present behind the oscillating system a closed air space which dampens the diaphragm in case of pulse-like movements. The penetration of foreign bodies into the air gap is prevented in accordance with a further development of the invention which is characterized by the fact that the support of the moving coil (2) contains a forward-extended section (4) which extends, while retaining a slight clearance, into a cap-shaped part (9) which represents a continuation of the extension (8) of the magnet core (7) for the moving coil (1).

One advantageous feature in this connection furthermore consists in the fact that the electrodynamic loudspeaker having a cone diaphragm is characterized by the fact that the support (2) of the moving coil (1) is extended beyond its point of attachment to the diaphragm (3) up into the space within the cone diaphragm (3) and extends, by the end of this extension (4), while retaining a slight radial clearance (10), into a cap-shaped part (9) which is secured firmly to the loudspeaker.

Furthermore, the electrodynamic loudspeaker is characterized by the fact that the cap-shaped part (9) is fastened to the magnet core (7) of the moving coil (1).

In addition to this it is of advantage for the extension (4) of the moving coil (1) to extend into the vicinity of the plane of the edge of the loudspeaker, for the cap-shaped part (9) to be enlarged radially to form a partial covering (12) of the cone chamber and for this enlargement to contain passages (11) located in axial direction.

Figure 2:
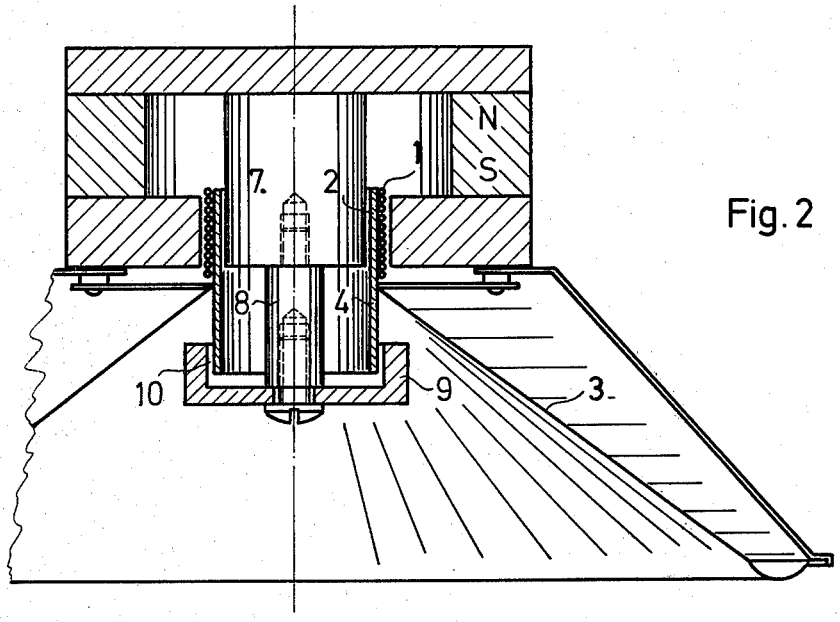

Finally, another advantageous feature consists of the fact that the moving-coil support (2) together with its extension (4), consists of light metal of good thermal conductivity. With the above and other objects and advantages in view, the present invention will become more clearly understood in connection with the detailed description of preferred embodiments, when considered with the accompanying drawing, of which:

FIG. 1 shows an illustrative embodiment of a loudspeaker of the aforementioned type, seen in lateral sectional view, and FIG. 2 shows a similar view of another embodiment of the invention Referring now to FIG. 1 of the drawing a moving coil 1 and a diaphragm 3 are arranged in the customary manner. On the magnet core 7 of the moving coil 1 there is fastened an extension 8 of approximately the same diameter. It is enlarged at its front end to form a partial covering 12 of the cone chamber, which covering is substantially flat. The diameter c of this covering 12 is only half as large as that of the cone opening d. The central part b of this covering 12 forms a closed surface of a size equal to one and a half times the diameter a of the magnet core 7 of the moving coil 1. The remaining edge region c-b of the covering 12 is provided with passages 11 which are located axially i.e. in the direction of radiation of the loudspeaker, and the cross sections of which take up approximately one-half of this remaining edge region c-b.

With respect to the shaping of the body for the influencing of the acoustic impression which the hearer obtains, it may be pointed out that efforts to improve the acoustic impression—which are as old as the loudspeaker itself—are difficult since the attempts at this concern local changes of air oscillations the behavior of which is not readily predictable in advance and which furthermore can, for all practical purposes, not be measured. They also depend very greatly on the forms of oscillation which are fed to the loudspeaker, and certain forms of oscillation cannot be imitated in the laboratory.

In order to avoid the possibility of foreign bodies entering into the air gap between the moving coil 1 and its magnet core 7, the moving-coil support 2 has a forward-extended section 4 which, while maintaining a slight clearance 10, extends into a cap-shaped part 9 of the loudspeaker covering 12 so that the inside of the loudspeaker system is accessible through a narrow air gap 10 which is open only towards the rear.

In electrodynamic loudspeakers having a cone diaphragm it is customary to protect the air gap between the magnet core and the moving coil by means of a cap in the manner which has already been described, at the cost of the disadvantages which have also been described above.

The object of the present invention is to improve this arrangement, intended to prevent the penetration of foreign bodies, in such a manner that the loudspeaker provides a more natural acoustic impression. The solution of this problem is provided by the present invention.

FIG. 2 shows an embodiment of a loudspeaker of the above-mentioned type in side section. The support 2 of the moving coil 1 is fastened in customary manner to the diaphragm 3 of the loudspeaker, but extends to a substantial extent 4 beyond this fastening point into the inside of the diaphragm 3. On the magnet core 7 of the moving coil 1 there is fastened an extension 8 which bears a cap-shaped part 9 which surrounds the extended part 4 of the moving-coil support 2 with a slight clearance 10 so that the inside of the magnet system, on the one hand, is not closed but, on the other hand, penetration of foreign bodies is prevented to a sufficient extent. It is favorable in this connection that the remaining air gap 10 is open only towards the inside of the loudspeaker and is not located directly between the magnet poles, where the force of attraction is the greatest.

The extension of the moving-coil support permits furthermore a 20% better removal of heat from the moving coil when light metal is used for the moving-coil support, which fact not only increases the loading capacity of the loudspeaker but also counteracts the so-called thermal dampening which is produced by the corresponding increase in resistance with large current pulses.

A further development of the invention resides in the fact that the cap-shaped body 9 which prevents the penetration of foreign bodies is enlarged in such a manner that is partially covers the inside of the cone membrane and thus improves the acoustic radiation and at the same time also forms a certain protection against physical contact with the diaphragm (FIG. 1).

We claim:

1. An electrodynamic loudspeaker with a cone diaphragm and a body arranged concentrically within the cone diaphragm in order to influence the acoustic radiation, the cone diaphragm defining a cone opening, said body comprises a disc-shaped covering which is arranged in the vicinity of a plane of the edge of the loudspeaker, the covering having a diameter equal to about one-half of the diameter of the cone opening, said covering has:

a central part of a size equal to approximately one and a half times the diameter of the magnet core of the moving coil, said central part forms a closed surface; and an edge area, constituting the rest of said covering other than said said central part, being formed with axially disposed passages, the cross-sections of said passages occupying approximately one-half of said edge area.

2. An electrodynamic loudspeaker having a cone diaphragm disposed around a magnetic core of a moving coil and a body arranged concentrically in the inside of the cone diaphragm in order to influence the acoustic radiation, the cone diaphragm defining a cone opening and a cone space, said body comprising an extension of the magnet core of the moving coil, said extension extends up into the vicinity of a plane of the edge of the loudspeaker, said extension is enlarged at an end in disc shape forming a partial covering of the cone space up to a size equal to approximately one-half of the diameter of the cone opening, said covering has:

a central part of a size equal to approximately one and a half times the diameter of the magnet core of the moving coil, said central part forms a closed surface; and an edge area, constituting the rest of said covering other than said central part, being formed with axially disposed passages, the cross-sections of said passages occupying approximately one-half of said edge area.

3. The electrodynamic loudspeaker according to claim 2, wherein said extension means forms a pot-shaped part, a moving coil support extends towards a front into said pot-shaped part yet slightly spaced from said pot-shaped part defining a clearance therebetween.

* * * * *